United States Patent [19]

Eckert et al.

[11] Patent Number: 4,465,049

[45] Date of Patent: Aug. 14, 1984

[54] FUEL INJECTION APPARATUS FOR INTERNAL COMBUSTION ENGINES, IN PARTICULAR DIESEL ENGINES

[75] Inventors: Konrad Eckert; Max Straubel; Wilhelm Vogel, all of Stuttgart, Fed. Rep. of Germany

[73] Assignee: Robert Bosch GmbH, Stuttgart, Fed. Rep. of Germany

[21] Appl. No.: 223,953

[22] Filed: Jan. 12, 1981

[30] Foreign Application Priority Data

Jan. 12, 1980 [DE] Fed. Rep. of Germany ..... 3000960

[51] Int. Cl.[3] ..... F02M 39/00

[52] U.S. Cl. ..... 123/446; 123/506; 123/503

[58] Field of Search ..... 123/500, 501, 506, 467, 123/503, 502, 447, 446

[56] References Cited

U.S. PATENT DOCUMENTS

| | | | |
|---|---|---|---|
| 3,465,737 | 9/1969 | Dreisin . | |
| 3,486,493 | 12/1969 | Dreisin . | |
| 3,486,494 | 12/1969 | Dreisin . | |
| 3,667,438 | 6/1972 | Moulin | 123/506 |
| 4,184,459 | 1/1980 | Ishii | 123/467 |
| 4,387,686 | 6/1983 | Leblanc et al. | 123/446 |
| 4,398,518 | 8/1983 | Leblanc et al. | 123/446 |
| 4,398,519 | 8/1983 | Tissot et al. | 123/446 |

*Primary Examiner*—William A. Cuchlinski, Jr.
*Assistant Examiner*—Carl Stuart Miller
*Attorney, Agent, or Firm*—Edwin E. Greigg

[57] ABSTRACT

A fuel injection apparatus for internal combustion engines, in which the onset and end of injection are determined by a hydraulically actuated control slide. The injection pump of the apparatus, which is preferably combined with an injection nozzle to form a pump/nozzle unit, has a pump piston embodied as a differential piston, whose section having the larger diameter serves as an auxiliary pump piston and generates a control pressure ($p_S$) actuating the control slide. During its compression stroke the control slide, in order to initiate the onset of injection, closes an overflow line leading out of the pump work chamber; and during its return stroke, which is effected by the pressure drop in the control line, the control slide relieves the overflow line in order to control the end of injection. The control pressure ($p_S$) in the control line necessary for actuating the stroke movement of the control slide is controlled by the closure of this line by means of a control device and is built up during the compression stroke of the auxiliary pump piston.

8 Claims, 7 Drawing Figures

FIG.1
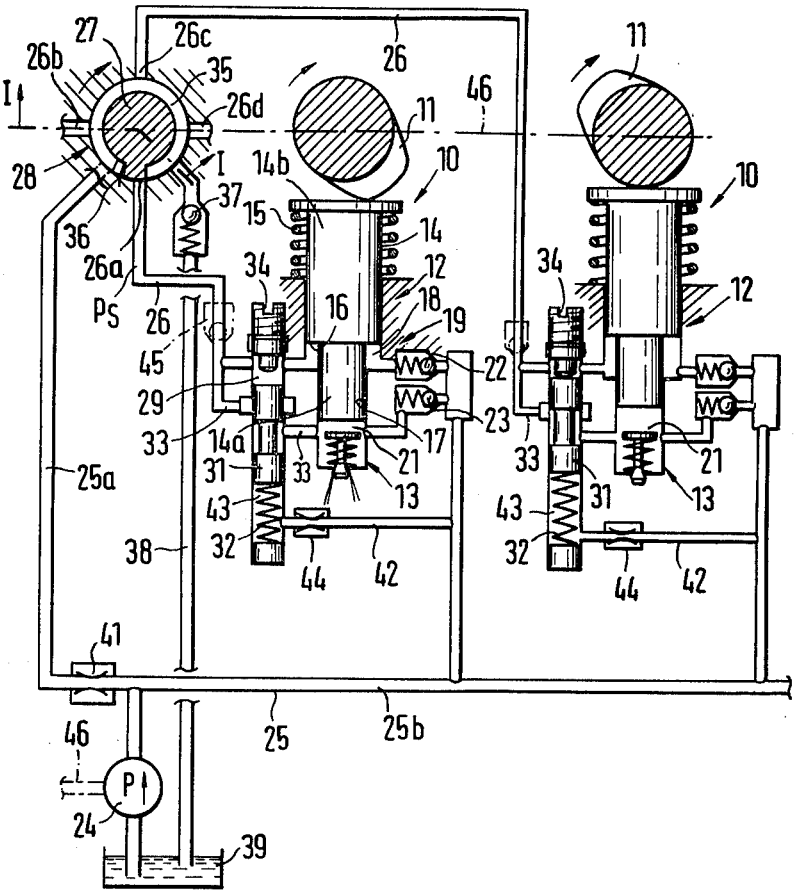
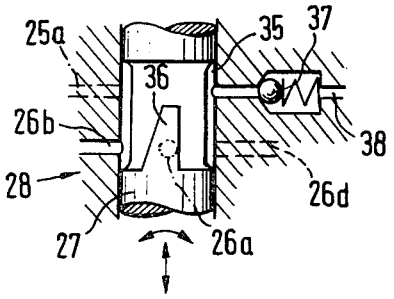
FIG.1a

FIG. 2
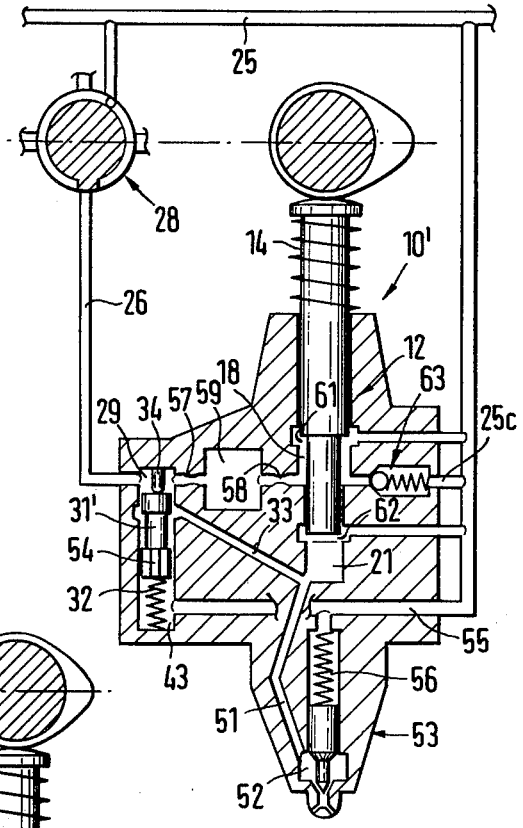
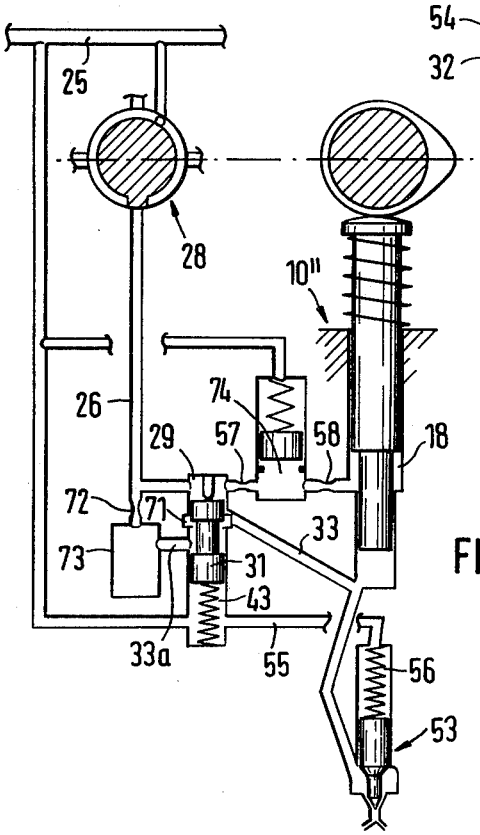
FIG. 3

FUEL INJECTION APPARATUS FOR INTERNAL COMBUSTION ENGINES, IN PARTICULAR DIESEL ENGINES

The invention is based on a fuel injection apparatus for internal combustion engines. A fuel injection apparatus of this design is already known (U.S. Pat. No. 3,486,493), in which the injection pump is embodied as a pump/nozzle and the fuel injection quantity is determined by means of a hydraulically driven control slide inserted into an overflow line. This control slide determines the fuel injection quantity and the effective supply stroke of the injection pump by means of blocking the return flow out of the pump work chamber; and injection is terminated when this control slide opens the overflow line and the injection pressure can be relieved. In the known apparatus, the control slide is exposed to the pressure of the pre-supply pump, and it is actuated by means of pressure relief in its spring chamber containing the restoring spring. In order to initiate the onset of injection, thus only the actuation force which results from the pre-supply pump pressure minus the force of the restoring spring is available; and to terminate the injection, only the force of the restoring spring is available, because both end faces of the control pressure are placed under identical pressure at the end of injection. This limits the applicability of such an apparatus in high-speed engines.

A fuel injection apparatus of the same general type is known from U.S. Pat. No. 3,465,737, but in which the control slide is actuated by the control pressure of a separate injection pump, which acts as a control pump and is driven simultaneously with the pump/nozzle. In order to vary the injection onset, a known injection adjuster is built into the drive mechanism of the control pump, so that the total expense for the apparatus is quite high. The object of the invention is to obtain a compact injection apparatus, which is not expensive to manufacture, in which mechanical control elements are eliminated and which can be used in high-speed Diesel engines.

OBJECT AND SUMMARY OF THE INVENTION

In the fuel injection apparatus according to the invention, a sufficiently high control pressure is generated without requiring an additional control pump needing a separate drive means. The pump piston, embodied as a differential piston, may be embodied in two pieces or in one piece, as may be dictated by manufacturing considerations; the auxiliary pump piston is advantageously embodied, as a section of the pump piston whose diameter is larger than the rest of the pump piston.

As a result of the characteristics disclosed, structural embodiments, improvements, and advantageous modifications of the fuel injection apparatus disclosed can be attained. Thus the auxiliary pump and the pump work chamber can be filled via filling valves, or via pre-stroke control ports. With the damping throttle and/or damping reservoir introduced into the control line, the pressure waves which occur in the control line are reduced in amplitude and increased in wave length. As a result, it is possible to prevent the injection quantity from being dependent on the camshaft rpm of the system as a whole to an undesirably great extent. Fluctuations in the lines which may occur between the valve assembly and the pressure chambers of the control slides are uncoupled from the pressure chamber of the control slide by means of check valves inserted into the control line. If the control lines are connected to a common manifold controlled by the control apparatus, then the check valves serve to separate the control lines of the injection pumps not actuated at a particular time from that control line which has at that time just been pressurized so as to control the injection; this prevents retroactive influences on the control slides of the injection pumps which have not been actuated.

A simplified disposition of the lines is attained and as a result the pressure surges which occur at the end of injection are kept remote from the pressure chambers of the control slides, or else are so greatly damped that no pressure surges, which would cause after-injections, can take place in the pressure chambers of the control slides. In order to prevent an impermissibly great pressure increase in the auxiliary pump chamber and control line, an overpressure valve is inserted into a line section connecting the auxiliary pump chamber with a return flow line. The damping throttle damps the stroke movement of the control slide such that excess fluctuations are eliminated or reduced in intensity. The flow throttle inserted into the low-pressure line enables a scavenging of the auxiliary pump chamber and of the pump work chamber in all the injection pumps not actuated during an interval when supply is not taking place.

With the characteristics set forth, an electrical control of the injection onset and the injection quantity can be attained using only a single magnetic valve assembly. The characteristics of claim 13 prevent the pressure waves, which occur in consequence of the control of one injection pump, from exerting retroactive influence on the other injection pumps, that is, those not functioning at a particular time.

Extremely short switching times are attained, with magnetic valves which are already available in the apparatus, as a result of the arrangement claimed in claim 14 set forth.

A fuel injection apparatus is disclosed which has a central control apparatus including a rotary distributor, in which the metering slide, which is actuatable solely for the purpose of varying the supply quantities and the injection onset, does not rotate with the drive mechanism; as a result, this metering slide can be actuated in a simple manner by known electrical or mechanical adjusting members. The particular advantage of this apparatus is the precise separation which it provides between the mechanically or electrically actuatable adjusting members which vary the injection onset and those which control the supply quantity.

The invention will be better understood and further objects and advantages thereof will become more apparent from the ensuing detailed description of four preferred embodiments taken in conjunction with the drawings.

BRIEF DESCRIPTION OF THE DRAWINGS

FIG. 1 is a simplified schematic representation of the first exemplary embodiment of the invention, having two injection pumps embodied as pump/nozzles and shown in cross section;

FIG. 1*a* is a cross section shown only in part, taken along the line I—I of FIG. 1;

FIG. 2 is a simplified schematic representation of the second exemplary embodiment of the invention, having only one pump/nozzle;

FIG. 3 shows the third schematic exemplary embodiment, having the lines disposed in a simpler fashion than in the embodiment of FIG. 2;

DESCRIPTION OF THE PREFERRED EMBODIMENTS

Figure 4:
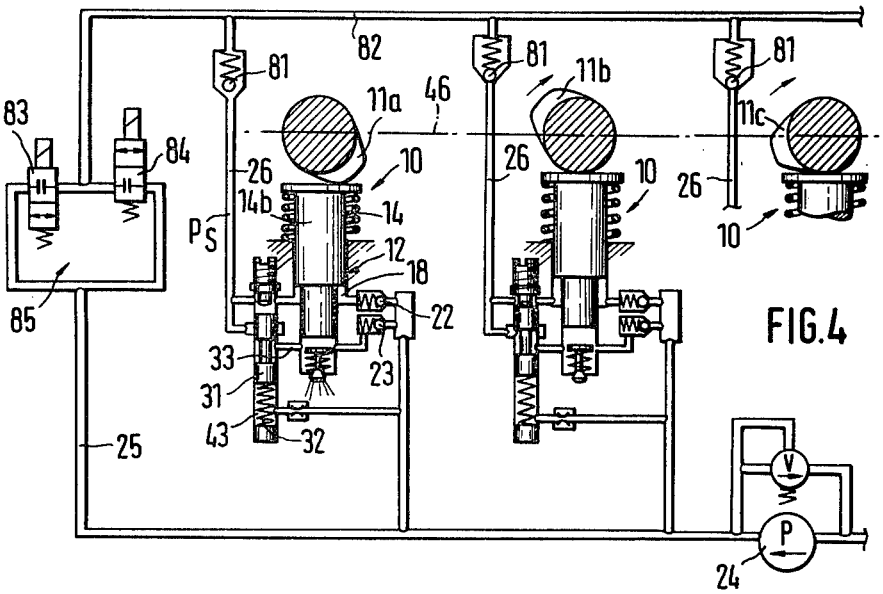
FIG. 4 shows the fourth schematic exemplary embodiment, having a control apparatus embodied by a magnetic valve assembly.

In the fuel injection apparatus shown in FIG. 1, two mechanically driven pump/nozzles 10 are shown, which substantially comprise an injection pump 12, which is driven by a drive cam 11 and embodied as a piston pump, and an injection nozzle 13, which is combined with the injection pump 12 and embodied as an injection valve opening toward the outside. The pump piston 14 is embodied as a differential piston, with the section 14*a* of smaller diameter being designated hereinafter as the pump piston 14*a* and the section 14*b* having the larger diameter being designated hereinafter as the auxiliary pump piston 14*b*. The auxiliary pump piston 14*b* is embodied in the illustrated example by a section of the pump piston 14 which has a larger diameter; however, it may also be embodied by a separate auxiliary pump piston, acting as a driver tappet, inserted between the pump piston 14*a* and the drive cam 11.

During its pressure stroke, which is effected counter to a tappet spring 15 by the drive cam 11, the auxiliary pump piston 14*b* protrudes with its effective working surface 16, representing the difference in surface area between the auxiliary pump piston 14*b* and the pump piston 14*a*, into an auxiliary pump chamber 18 whose size is increased relative to a cylinder bore 17 of the pump piston 14*a*, thus creating an auxiliary pump 19 which acts as the source of control fuel.

The auxiliary pump chamber 18 and a pump work chamber 21 exposed to the action of the pump piston 14*a* are both filled with fuel via filling valves 22 and 23, respectively, from a low-pressure line 25 supplied by a supply pump 24. The fuel is delivered into a control line 26 during the pressure stroke of the auxiliary pump piston 14*b*.

Each of the individual control lines 26 leading to the pump/nozzle 10 discharges into a control port 26*a*, 26*b*, 26*c* or 26*d*, respectively, of a control apparatus 28 which is equipped with a revolving rotary distributor 27. These four control ports 26*a*–26*d* communicate via four control lines 26 with the associated pump/nozzles of a four-cylinder Diesel engine, only two of which are shown in FIG. 1, these two being the pump/nozzles 10 actuated first and third in the course of ignition. A pressure chamber 29 of a control slide 31 adjoins each control line 26, the control slide 31 being displaceable in its axial direction by the control pressure $p_S$ counter to the force of a restoring spring 32, as mentioned above. The control slide 31 functions as a slide valve and is inserted into an overflow line 33, which in turn communicates permanently with the pump work chamber 21 and, in the illustrated example, discharges into the control line 26. In the case of the pump/nozzle 10 shown on the right-hand side of the drawing, the control slide 31 rests on a stop 34 which is adjustable for the purpose of aligning the individual pump/nozzles 10 and thus keeps the overflow line 33 open. Thus the pump work chamber 21 communicates, via the overflow line 33 and the control line 26, with an annular chamber 35 of the control apparatus 28 which is exposed to the supply pump pressure of the supply pump 24. In the case of the first pump/nozzle 10 shown in the left-hand side of the drawing, the control port 26*a* of the control line 26 is closed off by a control face 36 on the rotary distributor 27 (see FIG. 1*a* as well), and as a result of the pressure stroke of the auxiliary pump piston 14*b*, which has already been initiated by the drive cam 11, the control pressure $p_S$ in the control line 26 has increased and displaced the control slide 31 away from the stop 34 counter to the force of the restoring spring 32, thus interrupting the overflow line 33. Thus the flow of fuel out of the pump chamber 21 is blocked off both by the fill valve 23 and by the control slide 31, and as the pressure stroke of the pump piston 14*a* continues, the fuel, compressed to injection pressure, is expelled from the pump work chamber 21 and injected into the engine cylinders via the injection nozzle 13. As indicated in FIG. 1*a* by the corresponding arrows, the rotary distributor 27 may be displaced in a known manner in the axial direction for the purpose of varying the supply quantity, and it can be rotated relative to the drive mechanism for the purpose of varying the injection onset.

The annular chamber 35 of the control apparatus 28 communicates via a line section 25*a* of the low-pressure line 25 with the supply pump 24, and a return flow line 38 provided with a pressure maintenance valve 37 is also connected to the same annular chamber 35, so that excess fuel is carried back to a fuel tank 39 by way of this return flow line 38. The pressure maintenance valve 37 maintains a supply pressure of approximately 5 bar, for instance, in the entire system supplied by the supply pump 24; even in high-speed engines, this pressure enables sufficiently rapid refilling of the individual lines. In order to assure thorough scavenging of the pump work chamber 21 and the auxiliary pump chamber 18, which is intended particularly for the purpose of cooling and ventilating the pump/nozzle, a flow throttle 41 is inserted between a line section 25*b*, which supplies the individual injection pumps 12 directly with fuel from the supply pump 24, and the line section 25*a* of the low-pressure line 25, already mentioned, which leads exclusively to the control apparatus 28. As a result of this flow throttle 41, a higher pressure always prevails in the line section 25*b* than in the line section 25*a*, so that a pressure drop is present from the line section 25*b*, and the pump work chambers 21 and auxiliary pump chambers 18 connected with it, to the annular chamber 35 of the control apparatus 28 and thus to the pressure maintenance valve 37 as well. Except in the injection phase, this pressure drop enables the thorough scavenging of the chambers mentioned.

In order to damp the stroke movement of the control slides 31 in order to prevent excess fluctuation, a damping throttle 44 is disposed in each connecting line 42 leading from a spring chamber 43 containing the restoring spring 32 to the line section 25*b* of the low-pressure line 25. The lines are accordingly short in length, and there is a hydraulic reinforcement of the backward force in the control line caused by the restoring spring 32. If these advantages are given up, then it is also possible to provide a connection from the spring chamber 43 to the return flow line 38, which in that event then contains the throttle 44 (not shown).

If the lengths of the control lines 26 permit, a check valve 45 can also be inserted into them at a suitable location between the pressure chambers 29 and the control apparatus 28 as indicated by dot-dash lines in FIG. 1. In this case, the check valve 45 blocks the return flow of the control fuel from the control apparatus 28 back to the appropriate pressure chamber 29 of the control slide 31 whenever the control line 26 is blocked by the control face 36 of the rotary distributor 27. This valve 45 permits a buildup of pressure in the control line 26 as a whole, but it prevents control line pressure waves, arriving from the control face 36 of the rotary distributor 27, from reaching the pressure chamber 29 which is adjacent to the control slide 31.

In the illustrated exemplary embodiment, the individual pump/nozzles 10 are actuated directly by the drive cams 11, which are interconnected and driven via an overhead camshaft 46 indicated by dot-dash lines; as a result, the "stiff drive" required for generating high injection pressures is assured. Of course the pump pistons 14 may also be driven by the drive cams 11 via oscillating arms which are known per se (not shown). The rotary distributor 27 is also advantageously driven by the same engine camshaft 46, and a spatially favorable arrangement of the overall fuel injection apparatus is attained if the supply pump 24 as well is driven by the engine camshaft 46, as indicated with dot-dash lines on the supply pump 24.

In the further exemplary embodiments described in connection with FIGS. 2–4, identical elements or elements having the same function are given identical reference numerals; structurally modified elements are provided with a prime, and new elements are given new reference numerals.

In the second exemplary embodiment shown in FIG. 2, only one pump/nozzle 10' is shown, in which the pump work chamber 21 of the injection pump 12 communicates via a pressure line 51 with a pressure chamber 52 of a pressure-controlled injection nozzle 53. Its control slide 31', on its end remote from the pressure chamber 29, has longitudinal channels 54 by means of which, in the illustrated outset position with the control slide 31' resting on its stop 34, the overflow line 33 branching off from the pump work chamber 21 or from the pressure line 51 communicates across the spring chamber 43 and via a line 55 with the low-pressure line 25. A spring chamber 56 of the injection nozzle 53 is also connected to the line 55, so that further leakage lines, which would otherwise be required, are not necessary.

In the section of the control line 26 located between the auxiliary pump chamber 18 and the pressure chamber 29, there are two damping throttles 57 and 58, with a damping reservoir 59 disposed between them. These are intended for the purpose of reducing the amplitude of pressure waves arising in the control line 26, and an undesirably great dependence of the injection quantity on the rpm is avoided or at least reduced.

In place of the filling valves 22 and 23 used in the exemplary embodiment of FIG. 1, the auxiliary pump chambers 18 and the pump work chamber 21 of the exemplary embodiment shown in FIG. 2 are filled with fuel under supply pump pressure via pre-stroke control ports 61 and 62, embodied by annular grooves, from the low-pressure line 25, as long as the pump piston 14 remains in its illustrated position at bottom dead center. The buildup of pressure in the control line 26 and in the pump work chamber 21 begins only after a predetermined pre-stroke when the various edges of the end face of the pump piston 14 close off the pre-stroke control ports 61 and 62. By appropriate adaptation of the spacing of the various elements, the most favorable conditions can be attained for the buildup of the control pressure $p_S$ and the injection pressure.

In order to limit the maximum possible control pressure $p_S$ in the control line 26 to a permissible magnitude, for instance 60 bar, a line section **25*c* containing an overpressure valve 63 is attached at the lowest point of the auxiliary pump chamber 18, this line section in turn communicating with the low-pressure line 25** and thereby finally with the return flow line.

In this exemplary embodiment according to FIG. 2, the shutdown pressure surges coming from the pump work chamber 21 at the end of injection are kept remote from the control line 26 as a result of the communication of the overflow line 33 with the low-pressure line 25.

In the third exemplary embodiment shown in FIG. 3, which is illustrated in a more simplified manner from that of FIG. 2, the overflow line 33 of the pump/nozzle 10'' is connected, as in FIG. 1, to the control line 26. In order to avoid retroactive influences on the pressure chamber 29 of the control slide 31, however, a damping throttle 72 and a damping reservoir 73 functioning as a volumetric reservoir are disposed in a section **33*a* of the overflow line 33 located between a control location 71 of the control slide 31 and the control line 25. Here, as well, the spring chambers 32 and 56 of the control slide 31 and injection nozzle 53 communicate via the line 55 with the low-pressure line 25 and are thus exposed to the supply pump pressure of the supply pump 24 (on this, see FIG. 1). Two damping throttles 57 and 58 and a damping reservoir 74, here embodied as a piston reservoir, are inserted into the control line 26 for the same purpose as in the embodiment of FIG. 2**.

In the fourth exemplary embodiment shown in FIG. 4, the pump/nozzles 10 are identical to those of the first embodiment shown in FIG. 1, and the control slide 31 also functions in the same manner. In the fourth exemplary embodiment, three of the drive cams 11 are shown, which are connected to one another via the engine camshaft 46, and the control lines 26, which are of equal length for each pump/nozzle 10, are capable of being blocked relative to a manifold line 82 by check valves 81 whenever the connection and thus the return flow from the manifold line 82 to the low-pressure line, which is under supply pump pressure of the supply pump 24, are blocked by two magnetic valve assemblies 85 acting as a control device and comprising two magnetic valves 83 and 84. In order to better explain the functioning of this embodiment, the drive cams are here labelled **11*a*, 11*b* and 11*c*. The drive cam 11*a* has already moved the pump piston 14 of the first pump/nozzle 10 so far that the auxiliary pump piston 14*b* has increased the pressure of the fuel, which has been expelled out of the auxiliary pump chamber 18 and is located in the control line 26 and the manifold line 82 communicating with it, up to the control pressure $p_S$ and has displaced the control slide 31 into the position shown, where it blocks the overflow line 33. The pressure waves bouncing back from the magnetic valves 83 and 84 can be uncoupled by the check valves 81 from the control line 26 which has just been placed under pressure. At the same time, the control lines which are at this time not under pressure, that is, the control lines 26 for the two pump/nozzles 10 which are drivable by the drive cams 11***b* and 11*c* and which are at this time located in the bottom dead center position, are separated by the associated check valves 81 from the manifold line 82 which has been placed under pressure by the one pump/nozzle 10 which has been actuated. The magnetic valve assembly 85, as may be appreciated from the simplified representation of FIG. 4, comprises two magnetic valves 83 and 84 switched in parallel, by means of which, with appropriate overlapping of the control signals, extremely short control times are attainable, which could not be attained with a single magnetic valve. The mode of operation of these two magnetic valves 83 and 84, which are shown in FIG. 4 in their closing position, may be learned from the diagram given in FIG. 4*a*.

Figure 4A:
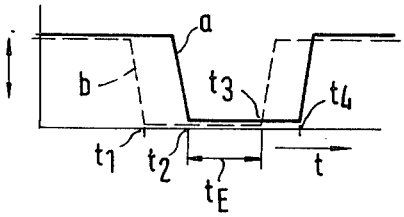
FIG. 4*a* is a control diagram for the apparatus shown in FIG. 4.

On the ordinate of the diagram of FIG. 4*a*, the closing position, "zu", and the opening position, "auf", of the two magnetic valves are plotted over the time t on the abscissa, with the aid of two curves a and b shown slightly displaced relative to one another in height. The solid-line curve a is plotted for the first magnetic valve 83 and the broken-line curve b is plotted for the second magnetic valve 84. As may be seen from curve b, at time $t_1$ the second magnetic valve 84 is already closed when at time $t_2$ the injection, indicated by time $t_E$, is initiated by means of the switchover of the first magnetic valve 83 from its opening position into its closing position—that, is, in FIG. 4, from position "auf" to position "zu". Then the injection is terminated when at time $t_3$ the second magnetic valve 84 opens and switches from position "zu" in FIG. 4*a* to position "auf". Shortly thereafter, the first magnetic valve 83 can also switch over at time $t_4$ into its open position, so that before the onset of the closing movements of the two magnetic valves 83 and 84 which occur at times $t_1$ and $t_2$, both magnetic valves are open and the control lines 26 are relieved of pressure toward the low-pressure line 25. As a consequence of the so-called "counterpoint switching" of two magnetic valves as illustrated in FIG. 4*a*, it would also be possible to use conventional pressure-equalized magnetic valves, available on the market and having a system-dictated minimum switchover time, in order to attain switching times which are extremely short—that is, which are reduced virtually to zero. The switching times, dictated solely by the stroke of the valve member, are indicated by the oblique portion of the curves. In addition, rapid and precise operation of both valves 83 and 84 is attained if the first magnetic valve 83 is excited upon the occurrence of its closing movement which initiates injection and if the second magnetic valve 84 is excited upon the occurrence of its opening movement which controls the termination of injection.

Figure 5:
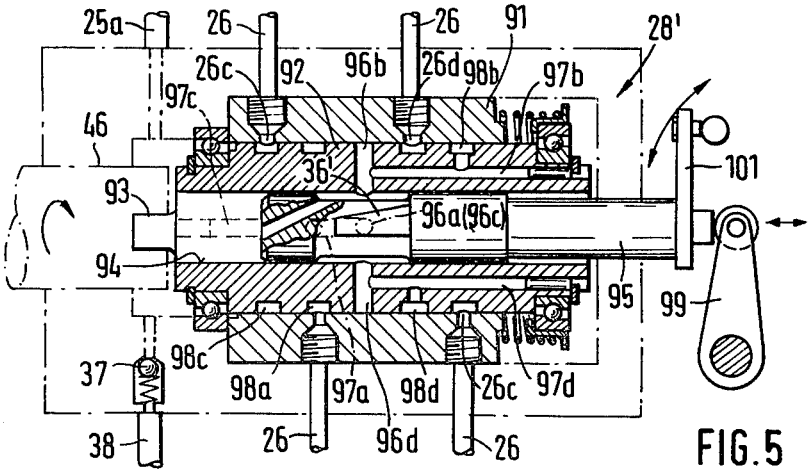
FIG. 5 is a simplified cross sectional view taken through a preferred form of embodiment of the control apparatus which is usable in the exemplary embodiments of FIGS. 1, 2 and 3.

In FIG. 5, a variant embodiment of the mechanical control device 28 used in FIGS. 1, 2 and 3 is shown. The control device 28' of FIG. 5 includes a control sheath 92, acting as a revolving rotary distributor, disposed in a stationary housing 91. This control sheath 92 is driven either by a shaft rotating in synchronism with the engine camshaft 46 as indicated by dot-dash lines or, as is assumed in this exemplary embodiment, directly by the engine camshaft 46 via a coupling without play, preferably a diaphragm coupling. However, in FIG. 5 this coupling is shown, for purposes of simplifying the drawing, as a claw coupling 93 shown shifted by 45°. The control sheath 92, in its central longitudinal bore 94, receives a metering slide 95 which is longitudinally displaceable in order to vary the supply quantity and is rotatable in order to vary the injection onset but is otherwise stationary. The metering slide 95 is provided with the control face 36'. Depending upon the number of control lines 26 communicating with the housing 91, the control sheath 92, disposed concentrically about the metering slide 95, is provided with one control port 96*a* and 96*b*, 96*c* and 96*d* each, which are embodied as radial bores and are located in a plane perpendicular to the longitudinal axis of the control sheath 92, the control ports 96*b* and 96*d* being located in the sectional plane of the drawing. The control port 96*a*, located above the sectional plane, is indicated by dot-dash lines, while the control port 96*d*, located below the sectional plane, is not shown and is therefore included in parentheses beside reference numeral 96*a*. Each of the control ports 96*a–d* communicates, via axial bores 97*a–d* which are closed relative to the pertinent end of the control sheath 92, with one each annular groove 98*a*, 98*b*, 98*c*, or 98*d*, respectively, on the circumference of the control sheath 92, each of these annular grooves being shifted axially in position relative to the others. Each annular groove 98*a–d* communicates in turn with one of the control lines 26 via the control ports 26*a–d* in the housing 91. Of these axial bores, only the axial bores 97*b* and 97*d* are shown in the plane of separation; the axial bore 97*c* located below the plane of separation is indicated by broken lines and the axial bore 97*a* located above the plane of separation is shown only in part by dot-dash lines. The longitudinal displacement of the metering slide 95 which is required for varying the supply quantity is effected via a lever 99, while the rotary movement required for varying the onset of injection is effected via a lever 101. Both levers can be actuated via known mechanical or electromechanical governors or injection adjusters; alternatively, hydraulic or electrohydraulic adjusting members could be made to engage these levers 99 and 101.

The fuel injection apparatuses described as exemplary embodiments are provided exclusively with pump/nozzles, because the advantages of the hydraulic control in accordance with the invention are best attained with such an apparatus. However, the principle of the invention can also be applied both to single pumps and to injection pumps combined to make series-type pumps.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A fuel injection apparatus for internal combustion engines, in particular Diesel engines, including per engine cylinder one mechanically driven pump piston of an injection pump supplied with fuel by a low pressure line from a supply pump and preferably combined with the injection nozzle to form a pump/nozzle unit, each said pump/nozzle unit having one control slide provided with a pressurized chamber actuatable by a control pressure of a source of control force counter to the force of at least one restoring spring, said control slide being inserted into an overflow line in permanent communication with a work chamber of said pump and arranged to close said overflow line in order to initiate the onset of injection and to open said line in order to terminate the injection, said apparatus further including a common control apparatus for all said injection pumps by means of which control apparatus said control pressure can be exerted via control lines upon said pressure chambers of said control slides, characterized in that said source of control force is embodied by an auxiliary pump, and further that said auxiliary pump includes an auxiliary pump piston disposed in close proximity to said mechanically driven pump piston and driven simultaneously therewith, said auxiliary pump piston having a larger diameter than said pump piston and arranged to extend into a correspondingly enlarged auxiliary pump chamber, and that said control pressure ($p_S$) required for actuation of said control slide can be influenced during the compression stroke of said pump piston and said auxiliary pump piston by means of a control device and that during every compression stroke of the auxiliary pump piston the control pressure ($p_S$) of the control fuel pumped into the pressure chamber of the associated control slide is built up by means of the control device in alternation for controlling the closing position of the control slide which triggers the onset of injection and for the return stroke of the control slide determining the end of injection which is relieved toward a fuel return and said auxiliary pump chamber and said work chamber of said pump piston are connected via filling valves connected with said low-pressure line.

2. A fuel injection apparatus as defined by claim 1, characterized in that said auxiliary pump piston is embodied by a section of said pump piston having a relatively larger diameter.

3. A fuel injection apparatus as defined by claim 1, characterized in that a check valve is arranged to block return flow of said control fuel from said control device to the associated pressure chamber of said control slide, said check valves being inserted into each of said control lines which connect said pressure chambers of said control slide with said control device.

4. A fuel injection apparatus as defined by claim 1, characterized in that said pump work chamber can be made to communicate with said control line by means of said overflow line controlled by said control slide, and wherein said overflow line further includes a sectional line.

5. A fuel injection apparatus as defined by claim 1, characterized in that a damping throttle is disposed in a connecting line which leads to a chamber containing said restoring spring.

6. A fuel injection apparatus as defined by claim 1, which includes a low-pressure line supplied by said supply pump and communicating with said control device further including a flow throttle, said flow throttle being inserted between one line section directly supplying said injection pumps with fuel from said supply pump and a second line section of a low-pressure line which communicates with said control device.

7. A fuel injection apparatus, as defined by claim 1, further including a rotary distributor, said rotary distributor being driven in synchronism with said injection pumps and by means of a control face arranged to control the connection from the individual control lines to the low-pressure line in order to control the control pressure actuating the control slide, characterized in that said rotary distributor comprises a control sheath disposed concentrically about a metering slide provided with said control face and that said metering slide is supported in the control sheath in such a manner that it is longitudinally displaceable to vary the supply quantity and rotatable to vary the injection onset.

8. A fuel injection apparatus as defined by claim 7, characterized in that the control sheath is further provided with one each control port per said fuel control line, said control ports being located in a plane perpendicular to the longitudinal axis of said control sheath and preferably comprising radial bores, and further that each of said control ports communicates with one each annular groove, arranged so as to be axially displaced relative to one another, on the circumference of the control sheath with each annular groove arranged to communicate with one of said control lines.

* * * * *